US005223649A

United States Patent [19]

Claridge

[11] Patent Number: 5,223,649

[45] Date of Patent: Jun. 29, 1993

[54] APPARATUS AND METHOD FOR PREVENTING ACCIDENTAL FIRING OF A WEAPON

[75] Inventor: Joseph M. Claridge, Northridge, Calif.

[73] Assignee: Claridge Hi-Tech, Inc., Northridge, Calif.

[21] Appl. No.: 763,025

[22] Filed: Sep. 20, 1991

[51] Int. Cl.[5] ..... F41A 17/42

[52] U.S. Cl. ..... 42/70.01; 42/70.08

[58] Field of Search ..... 89/138; 47/70.08, 70.01

[56] References Cited

U.S. PATENT DOCUMENTS

| | | | |
|---|---|---|---|
| 1,026,609 | 5/1912 | Schwarzlose | 42/70.01 |
| 1,354,365 | 11/1920 | Hammond | 89/138 |
| 4,352,317 | 10/1982 | Wilhelm | 42/70.08 |
| 4,454,673 | 6/1984 | Meidel | 42/70.08 |
| 5,070,634 | 12/1991 | Marino | 42/70.01 |

FOREIGN PATENT DOCUMENTS

| | | | |
|---|---|---|---|
| 114633 | 11/1900 | Fed. Rep. of Germany | 89/138 |
| 304280 | 3/1920 | Fed. Rep. of Germany | 42/70.08 |
| 135119 | 4/1952 | Switzerland | 42/70.01 |

*Primary Examiner*—Michael J. Carone
*Attorney, Agent, or Firm*—Lyon & Lyon

[57] ABSTRACT

A gun safety device including a bolt hold-open feature and a firing pin safety device to prevent the bolt and firing pin from sliding forward and causing the gun to fire.

2 Claims, 3 Drawing Sheets

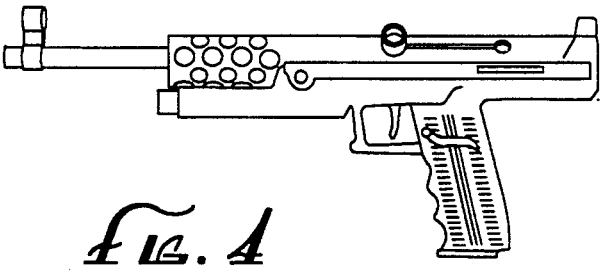
FIG. 4
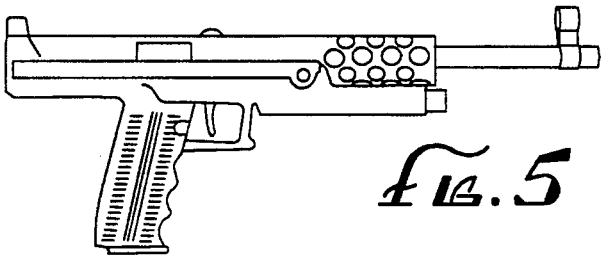
FIG. 5
FIG. 6
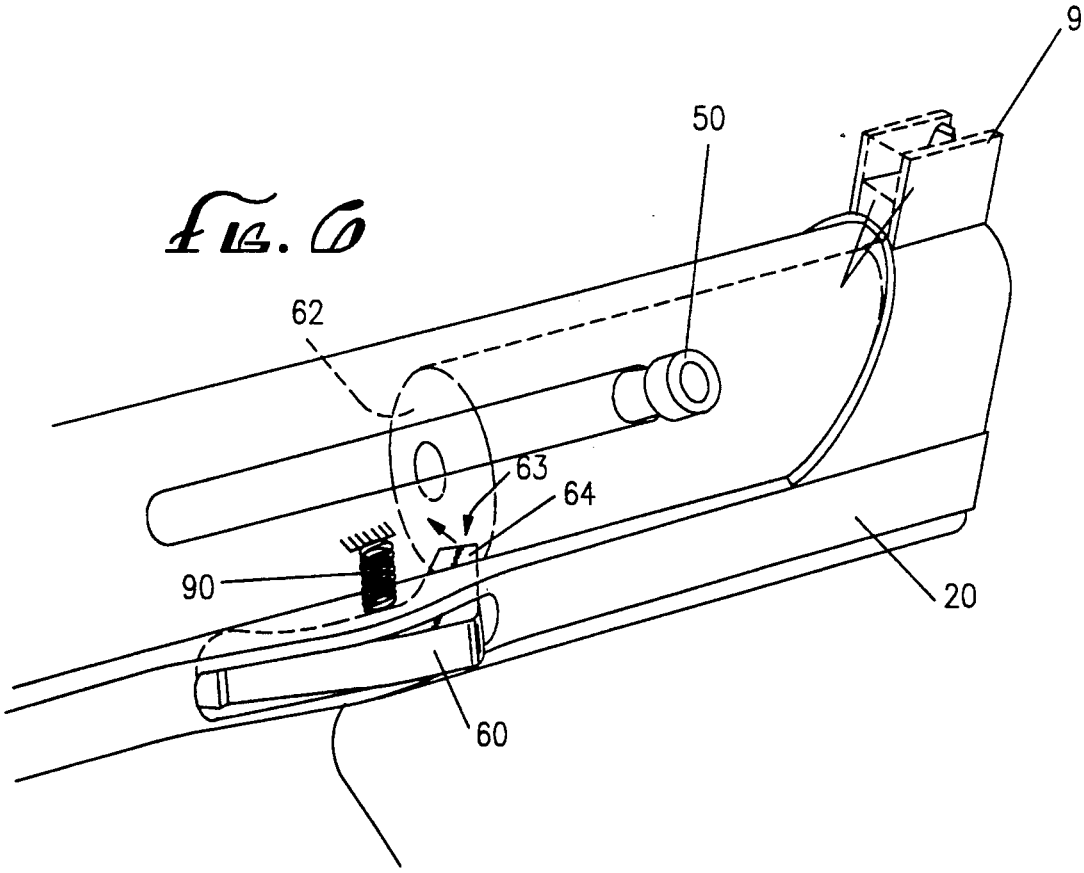

APPARATUS AND METHOD FOR PREVENTING ACCIDENTAL FIRING OF A WEAPON

BACKGROUND OF THE INVENTION

The present invention relates to the field of guns.

In guns, especially automatic and semi-automatic weapons which have a reciprocating bolt and automatic and semiautomatic feed of bullets from an ammunition clip, there is always a danger of accidental firing, either by virtue of the weapon being dropped or the accidental release of the bolt as it is being pulled back into a cocked position. Accordingly, there has been a need for minimizing the possibility of accidentally firing such weapons. The presently claimed firing safety devices go a long way towards preventing such accidental firing.

SUMMARY OF INVENTION

The present invention is directed to safety devices for guns and specifically a bolt hold-open device which engages the bolt causing it to remain in open or cocked position so it cannot cause the firing of the weapon.

This advance, in addition to the firing pin safety stop or notch apparatus, minimizes accidental firing should the firing pin move forward for any reason other than deliberately firing the weapon by pulling the trigger.

It is accordingly an object advantage of this invention to prevent the accidental firing of such a weapon.

BRIEF DESCRIPTION OF THE DRAWINGS

This and other objects and advantages of the present invention will become better understood through a consideration of the following description taken in conjunction with the drawings in which:

FIGS. 4 and 5 show a side view of pistols incorporating the inventions claimed herein.

FIG. 6 shows a schematic of the bold hold-open apparatus.

DETAILED DESCRIPTION OF THE PREFERRED EMBODIMENT

Figure 1:
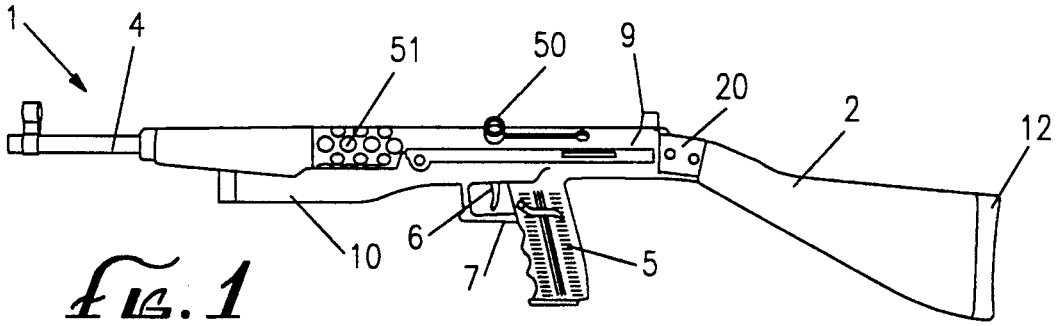
FIGS. 1 and 2 are side views of a rifle or carbine incorporating the inventions claimed herein.
Figure 2:
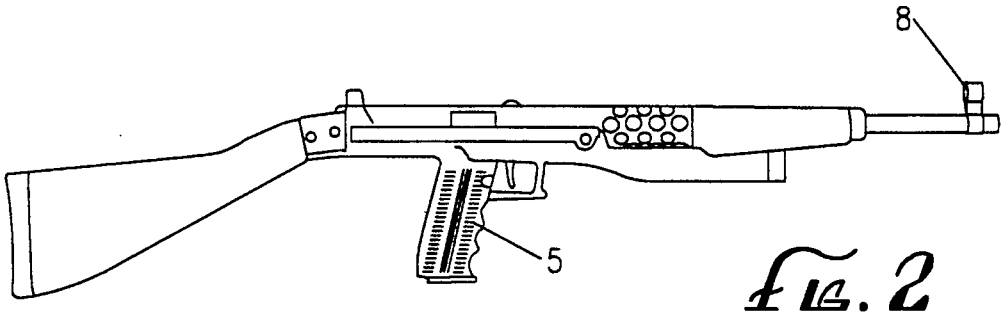
Figure 3:
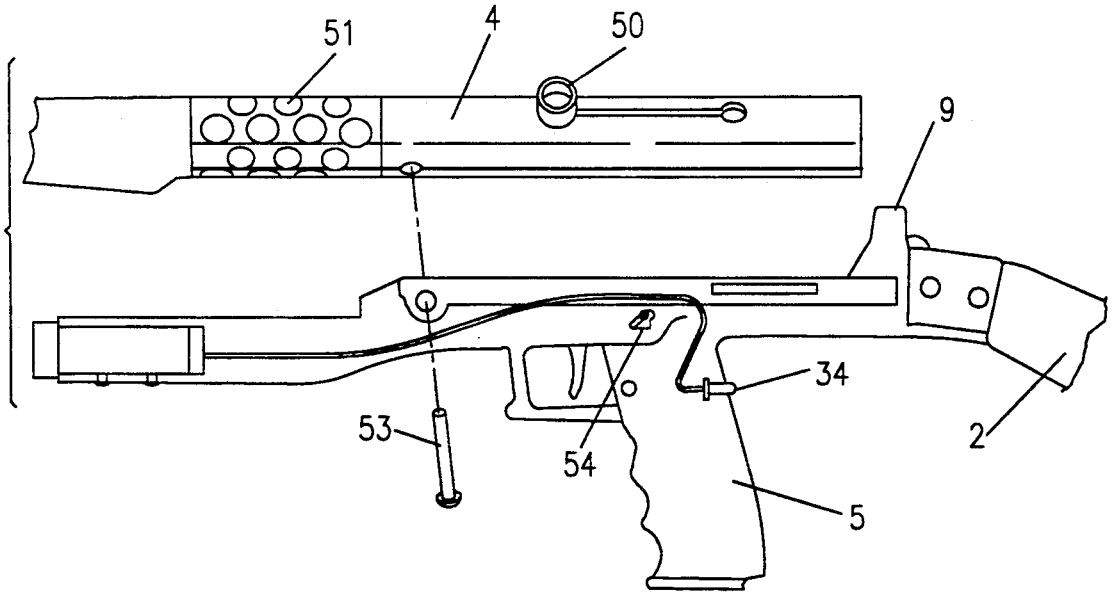
FIG. 3 is a partially schematic and cut out view of the central portion of the carbine or rifle which incorporates the inventions claimed herein.
Figure 7:
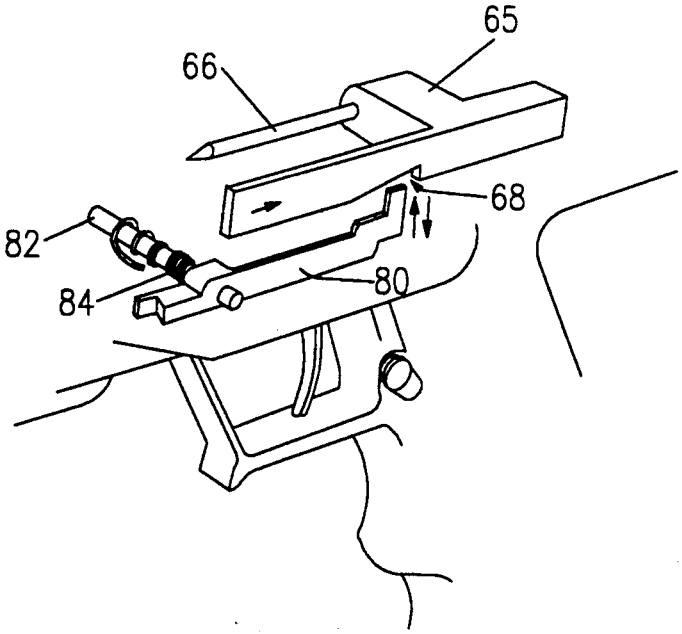
FIG. 7 shows another schematic illustrating the firing pin safety notch invention. Both the firing pin and the rocker are indicated therein.

Turning now to the drawings, and specifically FIGS. 1 and 2, the rifle or carbine embodiment of the present invention is shown. Each carbine typically has a housing 20, stock 2, barrel 4, pistol grip 5, which in the present embodiment is integrally constructed in the housing 20. The housing also contains the laser assembly 10. The housing attaches to (and in the preferred embodiment is integral with) trigger guard 7. Trigger 6 fires the weapon. Cocking knob 50 is attached to the bolt which is spring-loaded so as to slide forwards and backwards. (See FIG. 6 for more detail). The firing pin assembly 65 (FIGS. 7–9) is slidably attached to housing 20 and moves back and forth in relation to the barrel. When the cocking knob and bolt are pulled back, the firing pin assembly is arrested by a rocker and trigger mechanism (See FIG. 9) which can be disengaged by the pulling of the trigger 6.

Turning to FIG. 6, the present invention contemplates a bolt hold-open lever 60 which can additionally prevent the bolt 62 from proceeding forward and prevents the firing pin from moving fully forward to strike the cap and primer on the bullet. The lever 60 has a bolt or dog 64 in its periphery capable of pivotally extending in the path of the bolt. When the bolt is retracted to its furthermost backward position, the rear of the bolt hold-open lever can be depressed. This allows it to engage bolt at position 63, causing the bolt to remain open and locked in open position.

The bolt hold-open lever 60 is pivotally mounted and spring loaded so that, during the normal operation of the gun, it is forced out of the way of the bolt. To disengage the bolt hold-open lever, one retracts the bolt allowing the hold-open lever 60 to disengage and be displaced from the path of the bolt thus allowing the bolt to return to its closed position. The bolt hold-open device can thereafter be activated by manual operation if one wishes to restart the cycle and immobilize the bolt to remain open and not fire.

Figure 8:
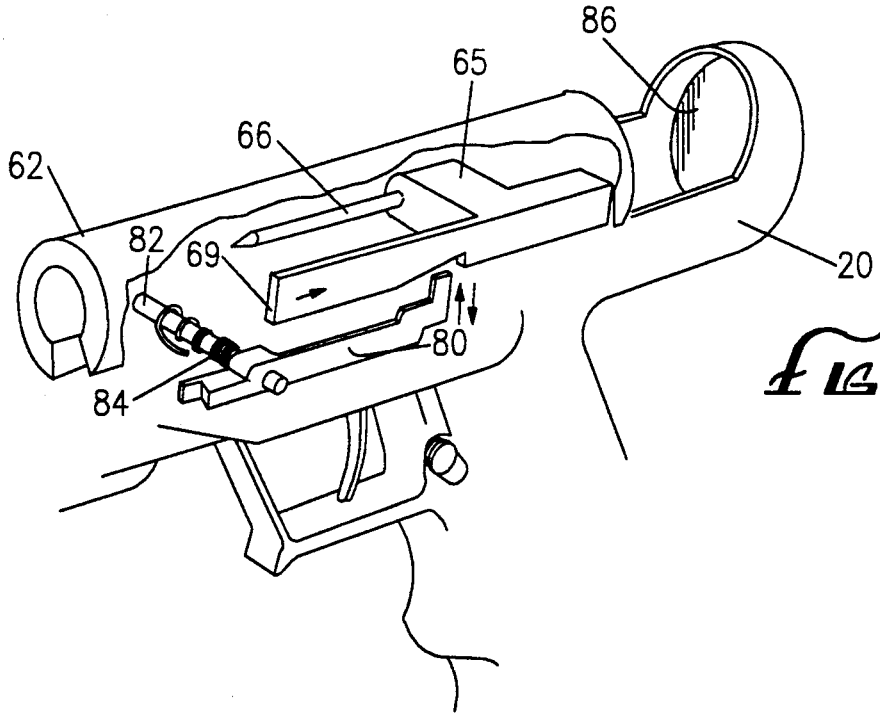
FIG. 8 indicates an assembly schematic indicating the relationship between the various elements.
Figure 9:
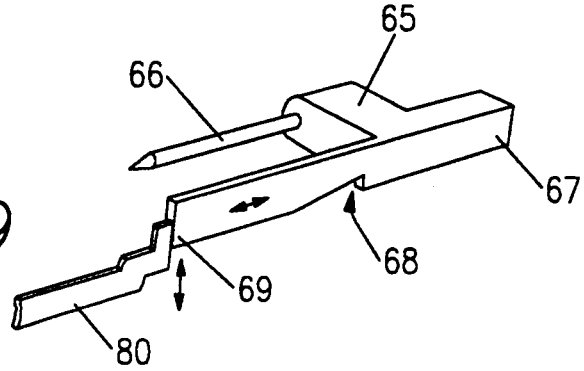
FIG. 9 also indicates the relationship between the rocker and firing pin in a cocked position.

We now proceed to the embodiment of the invention in FIGS. 8 and 9 which illustrate the firing pin safety notch feature. This apparatus provides additional safety protection should the firing pin move forward for any reason other than to deliberately fire the weapon when the trigger is pulled. By its operation, the forward motion of the firing pin can be stopped by the rocker stop 80 sliding into intermediate notch 68. The firing pin assembly 65 with the pointed striker 66 hits the cap and primer on the shell. The firing pin assembly has a substantially rectangular element or flange 67 which slidably moves forward and backward between locked and unlocked positions. The flange 67 has an intermediate notch or stop 68 machined in its intermediate portion. If the firing pin is allowed to slide forward during the cocking process for any reason, accidental or otherwise, the forward motion of the firing pin is stopped by the rocker sliding into the notch. In other words, the rocker is pivotally mounted to engage said firing pin. Rocker assembly 80 is a substantially horizontal and elongated section which pivots on pivot pin 82. Rocker spring 84 urges the rear portion of the rocker arm (which engages the notch) in a downward position away from the firing pin assembly. The gun can only discharge if the trigger is pulled back which (through a sear or cam assembly, which is not shown) lowers the rocker out of the path of the firing pin which can then slide forward and set off the cartridge. After cocking the weapon, the firing pin is in firing position. If for any reason (for example; dropping the gun, lack of strength in pulling back the bolt, etc.) the firing pin accidentally moves the safety notch forward, the weapon is prevented from accidentally discharging or "slap firing", as this is sometimes called in the industry.

Thus, a novel bolt hold-open device and firing pin safety stop has been disclosed. While specific embodiments and applications of this invention have been shown and described, it would be apparent to those skilled in the art that many more modifications are possible without departing from the inventive concepts herein. The invention, therefore is not to be restricted except in the spirit of the appended claims.

I claim:

1. A bolt hold-open device for a gun having a housing comprising:

an elongated lever mounted in a slot in the housing of said gun having a backward portion oriented towards the rear of said gun; and a bolt slidably engaged in said housing;

said lever having a dog at its backward portion capable of pivotally extending in the path of said bolt;

said lever being pivoted with said backward portion being urged outwardly by a spring;

wherein said outward urging by said spring tends to disengage said lever from the bolt.

2. The bolt hold-open device of claim 1 wherein said elongated lever is capable of being manually selectively engaged with said bolt at all times.

* * * * *